US005598951A

United States Patent [19]

DeBano, Jr.

[11] Patent Number: 5,598,951

[45] Date of Patent: Feb. 4, 1997

[54] OIL FILTER DRAINING DEVICE

[75] Inventor: Richard J. DeBano, Jr., Waterford, Mich.

[73] Assignee: Ford Motor Company, Dearborn, Mich.

[21] Appl. No.: 537,345

[22] Filed: Oct. 2, 1995

[51] Int. Cl.[6] ..... B67D 5/00

[52] U.S. Cl. ..... 222/83; 222/88; 222/108; 222/541.2

[58] Field of Search ..... 222/80, 81, 83, 222/83.5, 88, 89, 90, 108, 541.2

[56] References Cited

U.S. PATENT DOCUMENTS

| | | | |
|---|---|---|---|
| 411,661 | 9/1890 | Haskell, Jr. . | |
| 2,613,851 | 10/1952 | Du Bois . | |
| 2,751,119 | 6/1956 | Manning, Sr. | 222/81 |
| 3,331,405 | 7/1967 | Gaudet | 222/81 X |
| 3,347,410 | 10/1967 | Schwartzman | 222/80 |
| 3,563,413 | 2/1971 | Gordon | 222/83.5 |
| 3,596,402 | 8/1971 | Palmer | 222/81 X |
| 4,081,006 | 3/1978 | Crowell et al. | 222/83.5 X |
| 4,267,945 | 5/1981 | Maynard, Jr. | 222/83.5 |
| 4,446,989 | 5/1984 | Brannen | 222/108 X |
| 4,778,081 | 10/1988 | Vaughan | 222/83.5 |
| 4,881,662 | 11/1989 | Tallman | 222/81 |
| 5,299,714 | 4/1994 | Kilgore | 222/81 |
| 5,325,995 | 7/1994 | Harrison et al. | 222/81 |
| 5,390,823 | 2/1995 | Kilgore | 222/81 |

*Primary Examiner*—Joseph Kaufman
*Attorney, Agent, or Firm*—Jerome R. Drouillard

[57] ABSTRACT

A device for draining an engine's oil filter before removal of the filter from the engine, in order to minimize oil spillage from the filter during its removal from the engine. This device includes a hollow shaft having a closed end and an open end, a piercing point attached to the shaft at the open end, a flexible polymeric boot attached to the shaft adjacent to and enshrouding the piercing point, and a polymeric covering enveloping the shaft between the closed end and the portion where the flexible polymeric boot is attached.

20 Claims, 4 Drawing Sheets

OIL FILTER DRAINING DEVICE

BACKGROUND OF THE INVENTION

1. Field of the Invention

The present invention relates in general to automotive hand tools, and more specifically to an automotive hand tool for draining automobile oil filters prior to removal of the filter from an automobile's engine.

2. Description of the Prior Art

Practically all engines (including those used in automobiles) utilize an oil lubrication system which incorporates an oil filter to filter the oil that is circulated throughout the engine. Typically, the oil filter is removably and sealably fastened to the engine itself, either by being screwed onto a threaded receptacle or by being held by clamps or other fastening means. Once installed, the oil filter functions like a sieve by catching and retaining harmful particulates found in the oil as the oil passes through it, thus removing these particulates from the circulating oil stream. Oil filters are typically constructed such that oil flows from the engine and into the filter through one or more inlet orifices, after which the oil flows into an interior circumferential chamber, then inwardly through a multi-layered paper filtering portion, then into an interior axial chamber, and finally back out of the filter and into the engine. Periodically, old particulate-laden oil filters must be removed and replaced with new oil filters.

There are a number of problems associated with the changing of oil filters. First, oil filters are often located in hard-to-reach areas on an engine, making it difficult to conveniently reach the oil filter by hand or otherwise. As automobile manufacturers increase the number and complexity of systems and components attached to the engine, accessing the oil filter becomes more and more difficult.

Second, changing an oil filter is messy. Whenever an oil filter is removed from an engine, the seal between the filter and the engine is broken and often some of the oil remaining in the filter is spilled onto the engine or other components below as well as on the person removing the filter.

Third, oil spillage is not only messy, but is also environmentally undesirable. Oil spilled during oil filter changes spills not only on the engine and surrounding components but also on the work area beneath, and even onto the roadways as it continues to drip from components onto which it spilled. Cleaning up this spilled oil is difficult and often requires the use of environmentally harsh cleaning compounds.

Prior attempts have been made to address these problems. In order to provide background information so that the present invention may be completely understood and appreciated in its proper context, reference may be made to two prior art patents as follows:

U.S. Pat. No. 5,299,714 discloses a device for draining and removing vehicular oil filters by puncturing the filter with the sharp end of the device; allowing the oil within the filter to drain out through the hollow inner portion of the device; and, once the filter has been drained, using an oil filter wrench in conjunction with another socket wrench to unscrew the filter from the threaded engine receptacle to which it is attached. However, this device has a number of drawbacks. First, the sharp, exposed end of the device is dangerous because it can easily scratch or puncture people or objects with which it comes in contact. Second, the distance between the tip of the puncturing end of the device and the base of the penetrating surface against which the resilient washer is disposed appears to be fixed. This may result in said distance being too short to allow puncture into the innermost chamber of long or large filters, or being too long to allow the outer filter wail to seal against the washer when puncturing small or short filters. The result in the former case is incomplete drainage of oil from the punctured oil filter, while the result in the latter case is a lack of or inadequate seal between the filter and the washer (further resulting in oil dripping uncontrollably from the puncture). Third, in using the device with some filters, it is possible for the device to penetrate the filter too deeply so as to not merely make a puncture in the filter wall, but also to cut out an entire circlet of the wall. This loose circlet has the potential of clogging up or restricting the flow through the device. Fourth, when using the device with its valve closed (so that the interior of the device serves as a reservoir), there is no easy way for the user of the device to determine how full the reservoir is. Fifth, given the wide variety of locations on an engine where the oil filter might be mounted as well as the variety of hoses, wires, and other interfering structures proximate to the engine, it may be difficult to position the non-puncturing end of the device while it is still engaged with the oil filter so as to allow for easy drainage through the device into a separate receptacle.

U.S. Pat. No. 5,390,823 discloses a device similar to the '714 invention mentioned immediately above, with the added feature of having a detachable handle portion, yet without the male oil filter socket wrench component, without the female socket wrench component, and without the resilient washer or any other means to seal the device against the punctured filter wall. The '823 invention also has the same drawbacks as the '714 invention, except that the '823 invention has no resilient washer or other means for sealing the device against the punctured filter, thereby creating even more of a leaking problem for this invention than for the '714 invention.

The present invention overcomes all of the above mentioned problems, while also providing several beneficial features not contemplated by the prior art.

SUMMARY OF THE INVENTION

According to the present invention, an automotive hand tool for draining an engine's oil filter before removal of the filter from an engine includes a hollow shaft having a closed end and an open end, piercing means attached to the open end of the shaft, a flexible polymeric boot attached to the open end of the shaft so as to enshroud the piercing means, and a polymeric covering enveloping the shaft between the closed end and the portion where the flexible polymeric boot is attached.

The hollow shaft has an open end and a closed end, which forms a receptacle or reservoir. The shaft also has a longitudinal axis from which longitudinal and radial directions are defined.

A piercing means is rigidly attached to the shaft's open end and points outward in a direction substantially parallel to the shaft's longitudinal direction. The piercing means is used to pierce an oil filter's outer wall and inner chamber wall.

The flexible polymeric boot has a neck portion and a shroud portion. The boot's neck portion is sealingly attached to the open end of the shaft, while the shroud portion extends outward both radially and longitudinally from the shaft so as to enshroud the piercing means when the device is not being used. The boot is constructed of a resilient material that allows the shroud portion to collapse when the device is being used so as to expose the piercing means for use in puncturing an oil filter. While the device is in use, the flexible boot forms a seal around the oil filter so that any oil spilled from the filter is contained within the boot and can flow into the hollow shaft's interior. When the device is removed from a filter that is has punctured and drained, the resilience of the boot material allows the boot to return to its preformed shape.

The polymeric covering envelopes the shaft between the closed end and where the flexible polymeric boot is attached. The polymeric covering provides an aesthetically pleasing yet functional surface covering for the device.

The present invention is used by placing the boot against the exposed end of an engine's oil filter, pushing the shaft toward the filter so as to collapse the boot and engage the piercing means against the gravimetrically lowest part of the filter, pushing the shaft or striking the closed end of the shaft, causing the piercing means to puncture both the outer wall and inner chamber wall of the oil filter, holding the shaft in place so as to allow the oil within the oil filter to drain through the puncture and into the interior of the hollow shaft, and then withdrawing the device after all the oil has drained out of the filter. Once the device is withdrawn, the boot will return to its preformed shape, thereby enshrouding the piercing means. The oil may then be removed from the device and properly disposed of, and the oil filter may be removed with little or no oil spillage from the filter.

One objective of the present invention is to provide a way of draining the oil from an engine's oil filter before removing the filter so as to minimize or eliminate the oil spillage normally associated with changing an oil filter.

Another objective of the present invention is to avoid the danger presented by exposed piercing means by instead providing a piercing means that is normally shrouded, except while the device is in use, thereby protecting the user and nearby objects from inadvertent scrapes and punctures.

A further objective of the present invention is to provide a way of puncturing the outer wall and inner chamber wall of both small, shallow filters and large, deep filters while providing a way of sealing the device against the outer wall of the filter so that little or no oil is spilled from the filter during the use of the device. This allows the device to accommodate oil filters from a wide range of sizes.

Still another objective of the present invention is to provide a way of puncturing a filter without cutting out a circlet or loose tab of material from the outer wall, thereby avoiding the potential of clogging up or restricting the flow through the device.

BRIEF DESCRIPTION OF THE DRAWINGS

The invention will be further described in connection with the accompanying drawings, in which.

DETAILED DESCRIPTION OF PREFERRED EMBODIMENTS

Figures 1, 1A, 2:
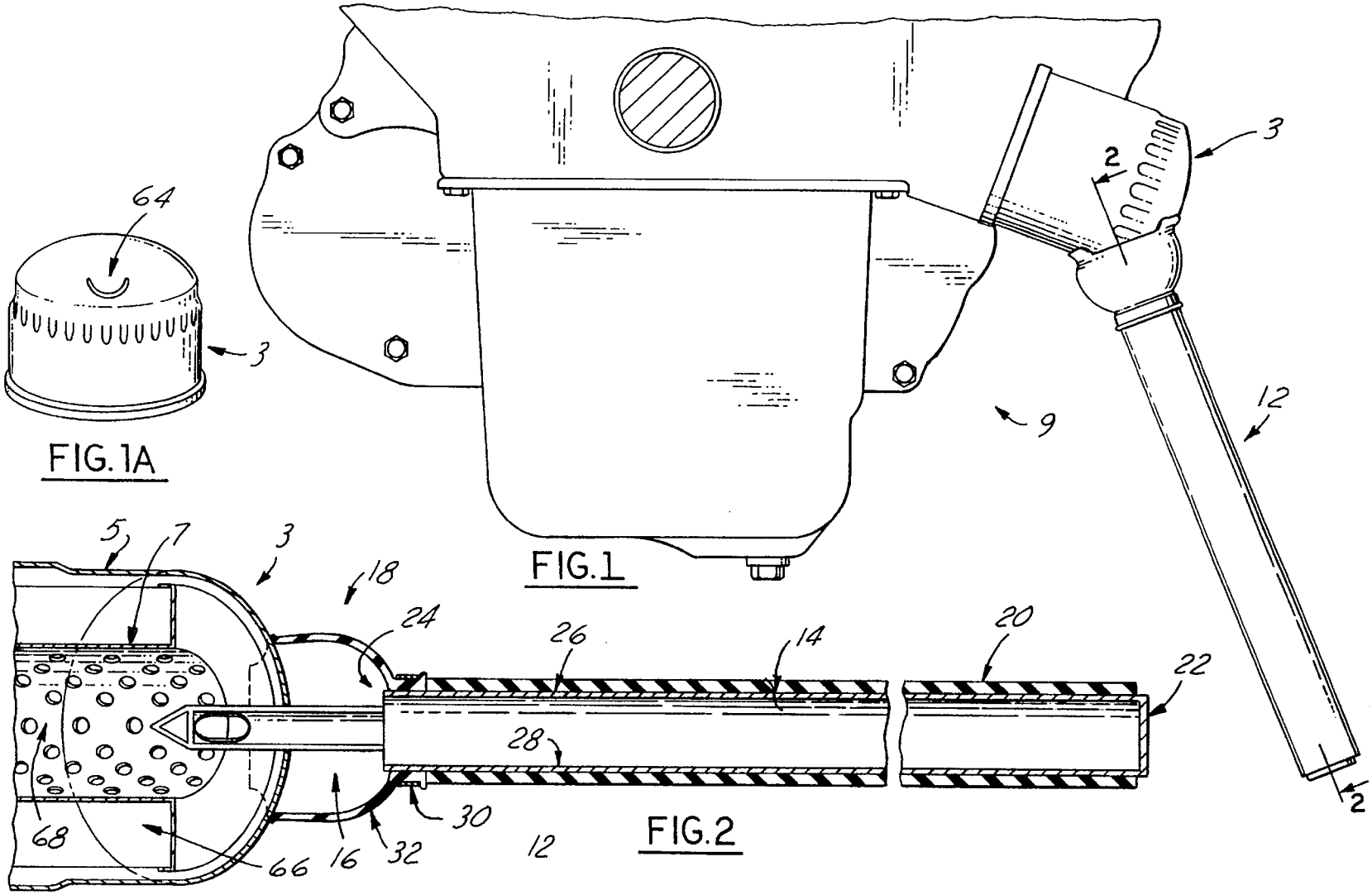
FIG. 1 is a perspective view of one embodiment of the present invention, illustrating its use to drain an oil filter prior to the filter's removal from an automobile engine.
FIG. 1A is a perspective end view of the oil filter shown in FIG. 1, looking along line 2—2, showing the punctured filter after withdrawal of the present invention therefrom.
FIG. 2 is a cross-section view of an embodiment of the present invention taken along line 2—2 of FIG. 1.
Figure 3:
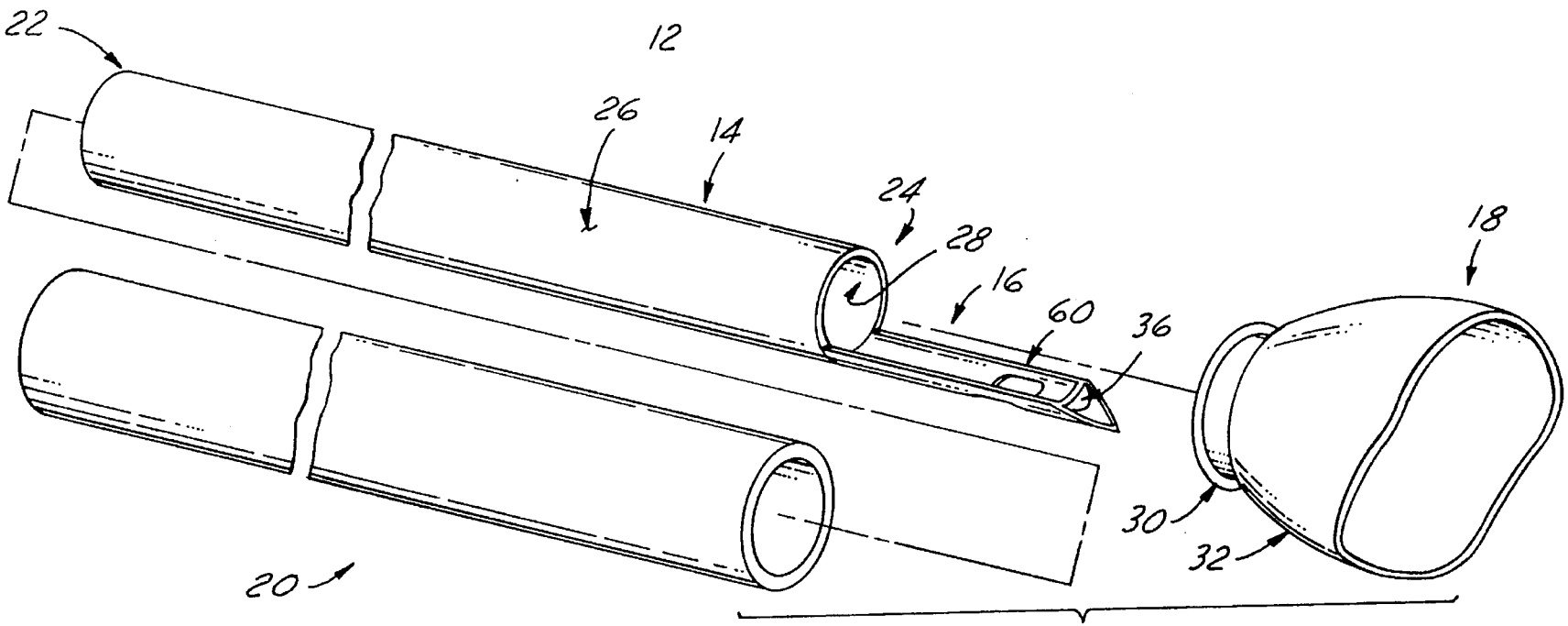
FIG. 3 is an exploded view of the embodiment shown in FIG. 1.

FIG. 1 shows a perspective view of one embodiment of the present invention 12; FIG. 2 shows a cross-sectional view of the embodiment taken along line 2—2 of FIG. 1; and FIG. 3 shows an exploded view of this same embodiment. FIGS. 1 and 2 illustrate the manner in which the present oil filter drainer 12 may be used to puncture outer wall 5 and inner chamber wall 7 of an engine oil filter 3 and to drain the oil therefrom so as to minimize or eliminate the oil spillage that normally occurs during an oil filter change. FIG. 1*a* shows a perspective end view of an oil filter upon which the device 12 has been used, showing a puncture made in the filter by the device 12.

A basic embodiment of oil filter drainer 12, as shown in FIGS. 1, 2 and 3, is constructed of four elements: hollow shaft 14 having a closed end 22 and an open end 24; piercing means 16 attached to the open end of shaft 14; a flexible polymeric boot 18 attached to the open end of shaft 14 and enshrouding piercing means 16; and a polymeric covering 20 which envelopes a portion of shaft 14. These four basic elements will now be described in further detail.

The first element is hollow shaft 14, as shown in FIG. 2. The shaft has an inner longitudinal surface 28 and outer longitudinal surface 26. Inner longitudinal surface 28 and ends 22 and 24 generally define an interior cavity of the shaft, while inner and outer longitudinal surfaces 28 and 26 generally define a longitudinal wall therebetween. Shaft 14 has a longitudinal axis, thereby defining longitudinal, radial (i.e., describing the direction of a line radiating orthogonal outward from the longitudinal axis), and transverse (i.e., describing the orientation of a plane whose surface is orthogonal to the longitudinal axis) directions. Each of ends 22 and 24 of shaft 14 has a generally transverse terminal edge therein. Furthermore, the shaft is further divided into two portions (a top portion and an under-portion) by a plane containing the shaft's longitudinal axis and passing through the shaft. A typical configuration for the hollow shaft 14 includes a hollow tube that is closed or capped at one end and open at the other end.

Since automotive oil filters typically contain up to about one quart of oil, the length and interior dimensions of shaft 14 may be chosen such that the volume of the interior cavity is at least one quart in capacity. Although a circular cross-section or tubular shaft is depicted in the drawings and is the preferred cross-sectional profile, other cross-sectional shapes (such as square, triangular, rectangular, etc.) may be employed without departing from the scope of the present invention.

Figure 4A:
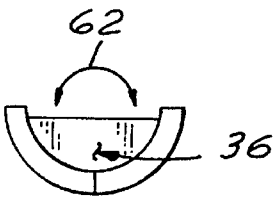
FIG. 4*a* is a cross-section view of the piercing mechanism.
Figure 4:
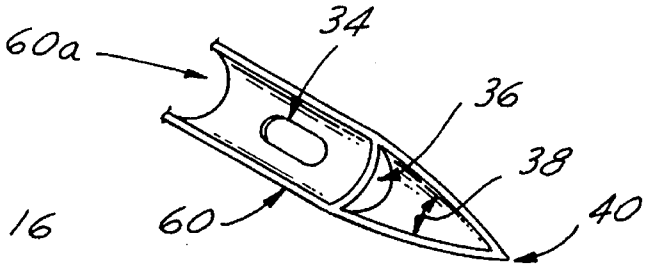
FIG. 4 is a perspective view of a piercing mechanism according to an embodiment of the present invention.

The second element, piercing means 16, is rigidly attached to open end 24 of shaft 14. A preferred embodiment of piercing means 16, as shown in FIGS. 4 and 4A, includes a generally elongate member 60 of predetermined length having two ends, one of the ends being V-shaped and terminating at a tip 40, while the other end, 60*a*, is a mounting end which is rigidly attached to the under-portion of open end 24 of shaft 14 with elongate member 60 and pointed tip 40 pointing in a direction substantially parallel to the shaft's longitudinal axis. The mounting end is preferably welded to the shaft, but the entire elongate member might also be formed as an integral part of the shaft. For example, one might use a piece of tube stock to form the hollow shaft and remove material from one end of the shaft in such a way that an elongate member is left sticking out longitudinally from the shaft.

The V-shaped end of the piercing means has two angled edges meeting at tip 40. It is preferred that the angle 38 between the two angled edges be between 45 and 90 degrees to maximize the ease with which the piercing means can penetrate the outer wall and inner chamber wall of an oil filter.

Elongate member 60 should preferably have a generally arcuate cross-section which is curved substantially about the shaft's longitudinal axis. To facilitate manufacturability, the radius of curvature of the member 60 should substantially equal that of the hollow shaft 14. The member 60 will have an interior and an exterior surface, and this interior surface will generally define a longitudinal trough.

Within this trough, a transverse wall portion 36 is affixed to elongate member 60. The wall portion 36 should be situated at a predetermined distance from tip 40 of the member 60, and this distance as well as the predetermined length of the elongate member should be chosen so that the piercing means 16 can puncture the outer wall and inner chamber wall of both small, shallow oil filters and large, deep oil filters. It is necessary to not only puncture the outer wall 5 so that oil from the interior circumferential chamber 66 may be drained, but also to puncture the inner chamber wall 7 so that oil may drain from the interior axial chamber 68 as well. This is illustrated in FIG. 2. Recommended dimensions for the predetermined length of the member 60 and the predetermined distance between the transverse wall 36 and the tip 40 are 4–8 cm and 1–2 cm, respectively.

Elongate member 60 is curved as described above so that when it penetrates an oil filter, it will punch a curved C-shaped hole in the outer wall 5, thereby defining a C-shaped tab 64 of outer wall material, as shown in FIG. 1A. Then, as piercing means 16 is pushed further into the filter, transverse wall 36 will deflect the C-shaped tab 64 toward the interior of the filter, thus creating a generally C-shaped hole through which oil may quickly and easily flow. In a preferred embodiment the elongate member will have a generally circular-arc cross-section whose arc angle is 180 degrees or less, as shown in FIG. 4A. A full circle or almost full circle cross-section is to be avoided as this may cause a circlet of wall material to be punched out. This circlet might then clog up the hollow shaft, thereby causing oil exiting the punctured filter to overflow and spill around the device 12 and onto the floor, user, or other automobile members below.

The elongate member 60 may also have a longitudinal aperture 34 cut through it, as shown in FIG. 4. This aperture may extend between the mounting end and where the transverse wall 36 is affixed. The purpose of this aperture is to facilitate the exit flow of oil from the filter's chambers. The aperture provides a way for oil to flow through the elongate member, into the longitudinal trough, and into the shaft's interior cavity without the piercing means actually clogging up this flow.

The third element, the flexible polymeric boot 18, is shown in FIGS. 2 and 3. The boot has a neck portion 30 and a shroud portion 32. The neck portion is sealably attached to open end 24 of shaft 14 about its outer longitudinal surface 26, as shown in FIG. 2. For ease of assembly, the cross-sectional shape of neck portion 30 should substantially conform to the cross-sectional shape of the shaft 14 at its open end 24. Shroud portion 32 has a top portion and an under-portion substantially corresponding in spatial relationship to the top and under-portions of the shaft when the boot is attached to the shaft. In order to protect the user and surrounding objects from inadvertently being scratched or punctured by the piercing means sticking out from the end of the shaft, the shroud portion of the boot is flared outward from the neck portion both longitudinally and radially in a substantially bell-like shape so as to enshroud the piercing means when the device 12 is not in use. Preferably, the boot is of single-piece construction, thereby allowing both neck and shroud portions to be constructed from the same flexible polymeric material. This material should allow collapse of the shroud portion while the device 12 is being used to pierce an oil filter such that the shroud portion seals against the outer wall of the oil filter while the device is held in place. This material should also allow the shroud to substantially return to its preformed shape when the device is disengaged from the oil filter.

The fourth element, polymeric covering 20, should envelope a predetermined portion of the shaft 14 and be in intimate contact with the shaft's outer longitudinal surface 22. The purpose for this covering is to provide a packaging for the shaft 14 that is more pleasing to look at and to feel than just a bare shaft alone. The covering should extend between the terminal edge of the closed end 22 of the shaft, the portion of the shaft occupied by the neck portion 30 of the polymeric boot, but should not cover the closed end 22. This is because the user may wish to tap on the closed end of the device with a tool or hand (in order to puncture a filter and force the piercing means therein). If the closed end were covered with the polymeric covering, the covering might easily wear off after repeated tapping on the end 22. For added aesthetic appeal, the covering may be molded in a variety of different colors, if desired.

Figure 5:
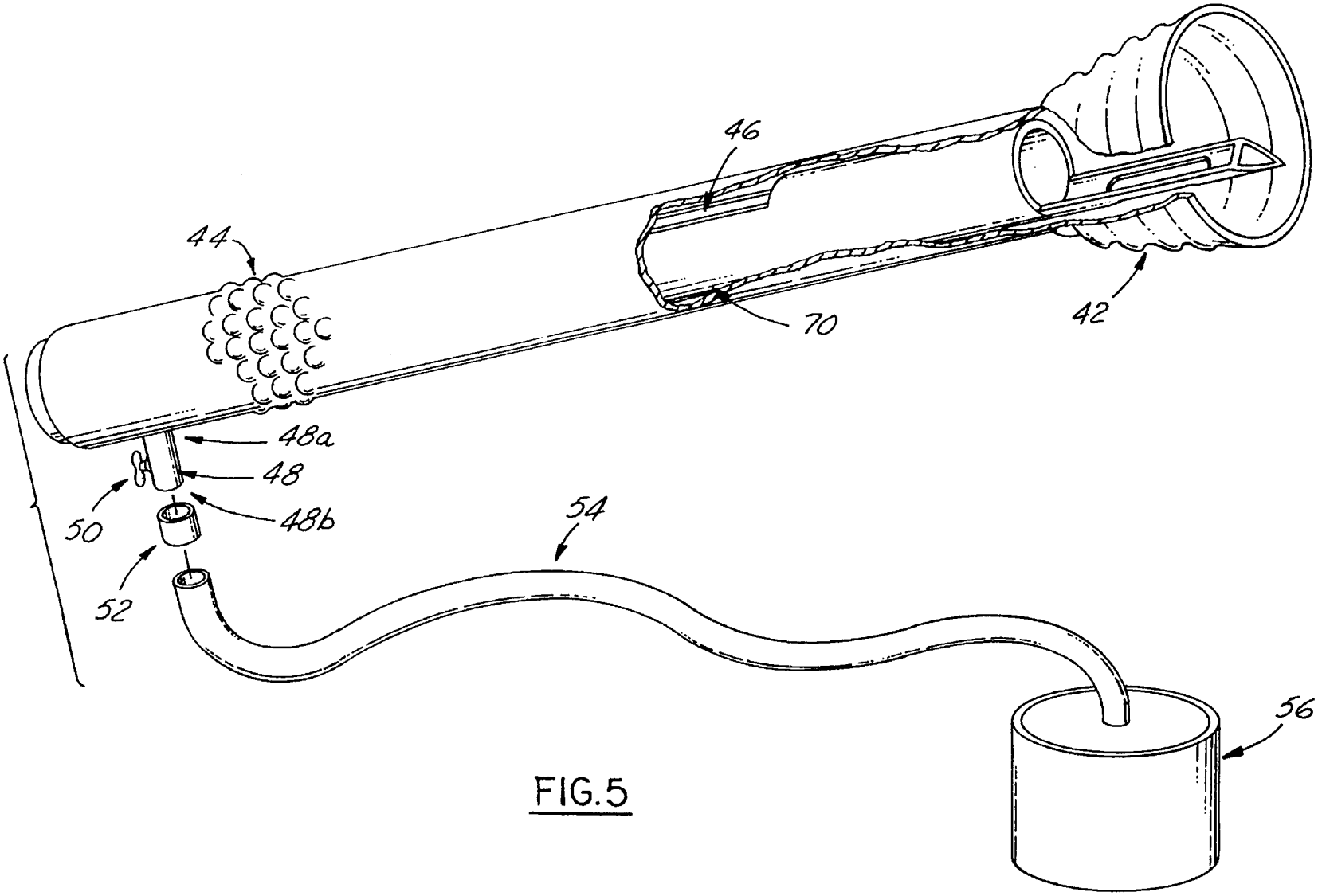
FIG. 5 is a partially cut-away perspective view of another embodiment of the present invention.
Figure 6:
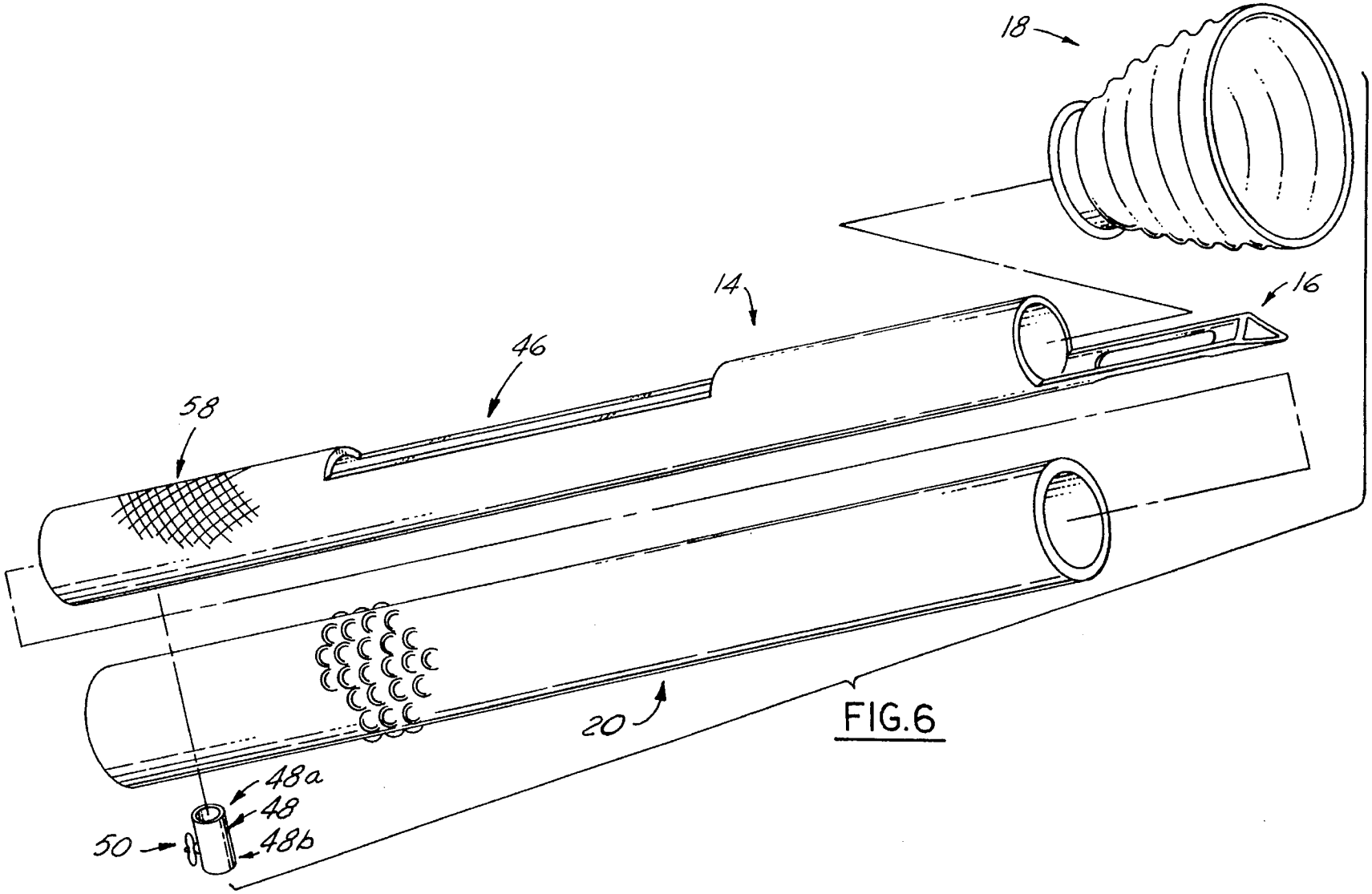
FIG. 6 is an exploded view of the embodiment shown in FIG. 5.

In addition to the features of the basic embodiment described above, many other features may be added to the device, as illustrated in FIGS. 5 and 6. FIG. 5 shows a partially cut-away perspective view of an alternate embodiment containing added features, while FIG. 6 shows an exploded view of this same alternate embodiment.

As shown in FIG. 5, outer surface 22 of shaft 14 may be roughened (e.g., knurled), thereby preventing slippage between the polymeric covering 20 and the shaft during use of the device 12. Furthermore, hollow shaft 14 and piercing means 16 may be made using metal, particularly a hardened metal such as hardened steel, to enhance the strength and durability of the present device.

Additionally, a longitudinal channel 70 may be formed along inner wall 28 of the under-portion of hollow shaft 14, running substantially between the shaft's closed end 22 and where the piercing means 16 is attached to the shaft. This channel would facilitate the flow of oil down to the closed end of the interior cavity during use of the tool.

Also, material may be removed from the top portion of shaft 14 between open end 24 and closed end 22, thereby creating a generally longitudinal aperture 46 thereat, as shown in FIGS. 5 and 6. This provides the benefit of making the shaft (and therefore the entire device) lighter, yet maintaining enough of the shaft's structural rigidity and strength. Alternatively, such an aperture could be created at other locations on the shaft, or a plurality of such apertures could be created. Additionally, the polymeric covering 20 could be molded using a light-transmissive (i.e., transparent or translucent) material. Use of a light-transmissive covering in conjunction with the above described aperture 46 provides a "window" in the device, through which the user can see how much oil is accumulating in the device during use in order to help avoid overflow and spillage.

Flexible polymeric boot 18 may be constructed from a material that provides substantial return force against the outer wall of a pierced oil filter to aid in the disengagement of the device from the filter. Also, shroud portion 32 of boot 18 may be molded, as shown in FIG. 3, in a single-chamfered, bell-like shape, such that the under-portion of shroud portion 32 extends further out from shaft 14 than does the top portion of the shroud. This shape facilitates sealing of the collapsed shroud against the outer filter wall 5 during use of the device. Alternatively, the shroud portion may be bellows-shaped, as shown in FIGS. 5 and 6; this shape also facilitates sealing against the filter.

The outer surface of the polymeric covering 20 may be textured, as shown in FIGS. 5 and 6, so as to improve the ability to grip the device. This is important when the device 12 is used in an environment, which may cause the covering 20 to become wet, oily, or greasy, such as in a garage.

To improve the wear and durability of the device, both flexible polymeric boot 18 and polymeric covering 20 may each be made of an oil-resistant polymer. This is important since most polymers are not oil-resistant, but, in fact, can be degraded by repeated exposure to grease and oil. However, it is not necessary that boot 18 and covering 20 be made from the same material. In fact, it is preferable that boot 18 be constructed from a flexible, resilient polymer, while covering 20 may be constructed from a more tough, wear-resistant polymer.

Once the device 12 is used to drain the oil from a filter, this oil must be emptied from the device. It may be desirable to accomplish this by draining the oil through a capped or valved spout provided at closed end 22 of shaft 14, as illustrated in FIGS. 5 and 6. A conduit 48, having a passage therethrough and an inward end 48*a* and an outward end 48*b*, is disposed at a location adjacent the closed end 22 of shaft 14 on the shaft's under-portion, with inward end 48*a* of the conduit fixedly attached to shaft 14 at the described location and with outward end 48*b* extending generally radially outward therefrom. Shaft 14 has a small radial passage through its longitudinal wall at the described location, and this passage aligns with the passage within conduit 48 so as to form a single and continuous port through which oil from the shaft's interior cavity may flow out. This can be accomplished by drilling a small hole through the shaft wall at the described location and welding or otherwise affixing a small tube over the drilled tube so that a drain spout is formed. Polymeric covering 20 has a hole, slot, or other clearance through which conduit 48 may protrude. Since polymeric covering 20 is intended to remain enveloped about shaft 14 during the useful life of the device 12 and not to be removed from shaft 14, it may be advantageous to construct the conduited embodiment of the device by first affixing the conduit to the shaft at the described location and then insert molding the polymeric cover over the shaft-conduit combination.

In addition to including a conduit 48 for the device 12, the conduit may also provide means for detachably connecting a flexible hose 54 to its outward end 48*b*. This could include threading the outer surface of the conduit's end, attaching quick-connect fittings, etc., depending on the type of mating fitting found on the hose to be used. A hose connected to the conduit can be used to direct oil out of the device's interior cavity and into a desired oil receptacle 56 such as an oil recycling container or catch pan. Furthermore, it is advantageous to provide means for detachably connecting a plug or cap 52 onto outer end 48*b* of conduit 48, in order to cap the conduit so that the device can be used as a receptacle to carry oil drained from an oil filter to a desired receptacle, at which point the plug can be removed and the oil allowed to drain into the receptacle. Even more advantageous, however, would be to provide a stopcock valve 50 affixed within the conduit, which would allow oil to flow from the interior cavity through the conduit and valve and out of the device into a desired receptacle with the valve open, and restricting this flow when the valve is closed. Perhaps the most advantageous embodiment would be to provide a conduit 48 having a stopcock valve 50 affixed therein and having means for detachably connecting a flexible hose 54 to the conduit's outer end.

The present invention in its various embodiments fulfills the above stated objectives of providing a way of draining oil from an engine oil filter before removing the filter so as to minimize or eliminate the oil spillage normally associated with changing an oil filter; avoiding the danger of inadvertent scratching and puncturing presented by exposed piercing means; providing a way of using the device on both small, shallow filters and large, deep filters while maintaining a substantially leak-proof seal against the filter's outer wall during use; and avoiding cutting out a loose tab of material from the filter outer wall when the filter is punctured.

Furthermore, the present invention provides many advantages not offered by previous devices for draining oil filters before removal, such as the use of an oil-resistant, aesthetically pleasing polymeric covering and flexible boot; the use of a light-transmissive polymeric covering and a window cut in the top portion of the hollow shaft to allow the user to see how much oil is accumulating in the device; the use of an aperture in the elongate member of the piercing means to promote easy flow through the member and prevent clogging; the piercing means' transverse wall which folds back the C-shaped tab of outer wall material for promoting easier flow of oil from the filter; and so forth.

While the invention has been shown and described in its preferred embodiments, it will be clear to those skilled in the arts to which it pertains that many changes and modifications may be made thereto without departing from the scope of the invention as set forth in the appended claims.

What is claimed is:

1. An oil filter draining device comprising:

a hollow shaft, having a closed end and an open end, said shaft having an inner and an outer longitudinal surface, said inner longitudinal surface and said ends generally defining an interior cavity of said shaft, said inner and outer longitudinal surfaces generally defining a longitudinal wall therebetween, the shaft further having a longitudinal axis, thereby defining longitudinal, radial, and transverse directions, each of said ends having a generally transverse terminal edge therein, said shaft further having a top portion and an under-portion, said portions being defined by two portions of said shaft as divided by a plane containing said longitudinal axis and passing through said shaft;

piercing means for piercing the outer wall and inner chamber wall of an oil filter, said piercing means being rigidly attached to and extending longitudinally outward from the under-portion of the open end of said shaft; and a flexible polymeric boot having a neck portion and a shroud portion attached to said neck portion, said shroud portion having a top portion and an under-portion substantially corresponding in spatial relationship to the top and under-portions of said shaft, said neck portion sealably affixed to the outer longitudinal surface of said shaft at said open end, said shroud portion flaring outward from said neck portion both longitudinally and radially in a substantially bell-like shape so as to enshroud said piercing means when said device is not being used and to provide means for both sealing the device against the outer wall of a filter and for conveying oil from the filter to said interior cavity when the device is being used, said boot being constructed of a material that allows collapse from and substantial return to said boot's preformed shape when force is applied thereto and removed therefrom, respectively, thereby providing resilient, cup-like engagement with the outer wall of an oil filter.

2. An oil filter draining device as in claim 1, wherein said piercing means comprises:

a generally elongate member of predetermined length having two ends, one of said ends being V-shaped end terminating at a tip, and the other end being a mounting end, said mounting end rigidly attached to the under-portion of the open end of said shaft with said member and said V-shaped end pointing longitudinally outward therefrom, said V-shaped end having two angled edges meeting at said tip, said member having a generally arcuate cross-section curved substantially about the longitudinal axis of said shaft and having an interior and an exterior surface, said interior surface generally defining a longitudinal trough; and a transverse wall portion affixed to said elongate member substantially within said longitudinal trough and situated at a predetermined distance from the tip of said V-shaped end, whereby a punctured portion of the outer wall of an oil filter is deflected inward by said transverse wall when said piercing means penetrates said filter, thereby facilitating the flow of oil from said filter.

3. An oil filter draining device as in claim 2, wherein the angle between the two angled edges of said V-shaped end is between 45 and 90 degrees.

4. An oil filter draining device as in claim 2, wherein the generally arcuate cross-section is substantially a circular arc with an arc angle of less than 180 degrees.

5. An oil filter draining device as in claim 2, wherein said generally elongate member has a longitudinal aperture cut therethrough, said aperture extending between said transverse wall portion and said mounting end.

6. An oil filter draining device as in claim 1, wherein the shroud portion of said flexible polymeric boot has a substantially single-chamfered, bell-like shape, such that the under-portion of said shroud extends further out from said shaft than does the top portion of said shroud, thereby providing means both for sealing the device against the outer wall of a filter, and for conveying oil from the filter to said interior cavity when the device is being used.

7. An oil filter draining device as in claim 1, wherein said flexible polymeric boot provides substantial return force against the outer wall of a pierced oil filter when disengaging said device from said oil filter.

8. An oil filter draining device as in claim 1, wherein said flexible polymeric boot as a bellows-like configuration.

9. An oil filter draining device as in claim 1, wherein said hollow shaft has material removed from said top portion between the ends of said shaft, thereby creating a generally longitudinal aperture thereat.

10. An oil filter draining device as in claim 9, wherein said polymeric covering is light-transmissive.

11. An oil filter draining device as in claim 1, wherein the outer surface of said shaft is roughened, thereby preventing slippage between said polymeric covering and said shaft during use.

12. An oil filter draining device as in claim 1, wherein said polymeric covering has a textured outer surface.

13. An oil filter draining device as in claim 1, wherein said piercing means and said shaft are made of hardened metal.

14. An oil filter draining device as in claim 1, wherein said polymeric covering and said flexible polymeric boot are each made of an oil-resistant polymer.

15. An oil filter draining device as in claim 1, wherein a conduit, having a passage therethrough and an inward and an outward end, is disposed at a location adjacent the closed end of said shaft and on the under-portion of said shaft, said shaft having a small radial passage through said longitudinal wall at said location, said inward end being fixedly attached to said shaft at said location with said outward end extending generally radially outward therefrom and with said conduit extending through said polymeric covering, whereby the passage in said shaft and in said conduit are aligned to from a single and continuous port through said passages allowing oil to flow from the interior cavity of said shaft therethrough.

16. An oil filter draining device as in claim 15, wherein the outward end of said conduit provides means for detachably connecting a plug thereto, thereby allowing oil to be directed out of said interior cavity and into a desired receptacle.

17. An oil filter draining device as in claim 15, wherein the outward end of said conduit provides means for detachably connecting a plug thereto, thereby allowing oil to flow from the interior cavity of said shaft through said conduit, while restricting flow when said plug is connected to the end of said conduit thereby allowing oil to be retained inside said interior cavity.

18. An oil filter draining device as in claim 15, wherein said conduit has a stopcock valve affixed therein, thereby allowing oil to flow from the interior cavity of said shaft through said conduit and said valve when said valve is open and restricting said flow when said valve is closed.

19. An oil filter draining device as in claim 1, further comprising a polymeric covering enveloping and in intimate contact with a predetermined portion of the outer longitudinal surface of said shaft and extending between the terminal edge of said closed end and the portion of the shaft occupied by the neck of said polymeric boot.

20. An oil filter draining device, comprising:

a hollow shaft, having a closed end and an open end, said shaft having an inner and an outer longitudinal surface, said inner longitudinal surface and said ends generally defining an interior cavity of said shaft, said inner and outer longitudinal surfaces generally defining a longitudinal wall therebetween, the shaft further having a longitudinal axis, thereby defining longitudinal, radial, and transverse directions, each of said ends having a generally transverse terminal edge therein, said shaft further having a top portion and an under-portion, said portions being defined by two portions of said shaft as divided by a plane containing said longitudinal axis and passing through said shaft;

piercing means for piercing the outer wall and inner chamber wall of an oil filter, said piercing means being rigidly attached to and extending longitudinally outward from the under-portion of the open end of said shaft;

a flexible polymeric boot having a neck portion and a shroud portion attached to said neck portion, said shroud portion having a top portion and an under-portion substantially corresponding in spatial relationship to the top and under-portions of said shaft, said neck portion sealably affixed to the outer longitudinal surface of said shaft at said open end, said shroud portion flaring outward from said neck portion both longitudinally and radially in a substantially bell-like shape so as to enshroud said piercing means when said device is not being used and to provide means for both sealing the device against the outer wall of a filter and for conveying oil from the filter to said interior cavity when the device is being used, said boot being constructed of a material that allows collapse from and substantial return to said boot's preformed shape when force is applied thereto and removed therefrom, respectively, thereby providing resilient, cup-like engagement with the outer wall of an oil filter; and a polymeric covering enveloping and in intimate contact with a predetermined portion of the outer longitudinal surface of said shaft and extending between the terminal edge of said closed end and the portion of the shaft occupied by the neck of said polymeric boot.

* * * * *